US012329247B2

(12) United States Patent
Dupre et al.

(10) Patent No.: US 12,329,247 B2
(45) Date of Patent: Jun. 17, 2025

(54) ACCESSORY TO PERSONALIZE AND STYLIZE APPAREL

(71) Applicant: Stylez LLC, Millsboro, DE (US)

(72) Inventors: Vanessa Dupre, Trainor, PA (US); Jeannine Duda, Linwood, PA (US); Candice M. Racite, Pennsville, NJ (US)

(73) Assignee: Stylez LLC, Millsboro, DE (US)

( * ) Notice: Subject to any disclaimer, the term of this patent is extended or adjusted under 35 U.S.C. 154(b) by 0 days.

(21) Appl. No.: 18/236,209

(22) Filed: Aug. 21, 2023

(65) Prior Publication Data

US 2025/0064172 A1 Feb. 27, 2025

(51) Int. Cl.
*A43C 9/06* (2006.01)

(52) U.S. Cl.
CPC ..... *A43C 9/06* (2013.01)

(58) Field of Classification Search
CPC ..... A43C 9/06; A43C 9/04; Y10T 24/3795; Y10T 24/3789; A44D 2203/00
See application file for complete search history.

(56) References Cited

U.S. PATENT DOCUMENTS 1,392,339 A * 10/1921 Kelly ..... A43C 9/06 24/715.6
1,420,632 A * 6/1922 Kelly ..... A43C 9/06 24/715.6
1,586,473 A * 5/1926 Rose ..... A43C 9/06 24/715.6
4,939,831 A * 7/1990 Doninger ..... B25B 33/00 29/263
5,289,613 A * 3/1994 Kohl ..... F16G 11/02 16/108
5,584,132 A * 12/1996 Weaver ..... A43C 9/02 24/715.4

(Continued)

FOREIGN PATENT DOCUMENTS

CN 102525033 12/2010
CN 202269475 6/2012

(Continued)

OTHER PUBLICATIONS

Shoelace Tips, 4pack—Alloy Shoe Lace Ends Tips, Cylindrical Tip Replacement for Shoestring (Electrophoretic Black), Walmart.com, Obtained Aug. 10, 2023.

(Continued)

*Primary Examiner* — Jason W San
*Assistant Examiner* — Louis A Mercado
(74) *Attorney, Agent, or Firm* — Stradley Ronon Stevens & Young, LLP

(57) ABSTRACT

A modular connector for mounting on a string. The connector includes an integral inner string attachment configured to grasp substantially permanently the string. An integral intermediate sleeve is made of a magnetic material, has a head and an inner face with a lip located in the inner face proximate the head, and is configured to enclose and hold the string attachment with the lip blocking the string attachment from exiting the intermediate sleeve after the string attachment has been inserted into the intermediate sleeve. An integral outer decorative cover is adorned with an indicia, has a bottom, and is configured to enclose the intermediate sleeve. A magnet is positioned in the bottom of the decorative cover to affix temporarily yet securely the intermediate sleeve flush inside the decorative cover. Also disclosed are a kit that combines two or more components of the connector and a method of using the connector.

18 Claims, 9 Drawing Sheets

(56) References Cited

U.S. PATENT DOCUMENTS

| | | | | |
|---|---|---|---|---|
| 6,112,380 | A | 9/2000 | Donlan et al. | |
| 7,246,417 | B1 * | 7/2007 | Huang | A43C 1/00 24/715.6 |
| 7,251,868 | B2 | 7/2007 | Curet et al. | |
| 8,852,373 | B2 | 10/2014 | Cheng | |
| 10,299,539 | B2 | 5/2019 | Finley | |
| 11,986,060 | B2 * | 5/2024 | Cheng | A43C 9/06 |
| 2006/0064856 | A1 * | 3/2006 | Chen | A43C 9/04 24/715.6 |
| 2008/0295305 | A1 | 12/2008 | Hsu | |
| 2010/0205791 | A1 * | 8/2010 | Cheng | A43C 9/04 24/715.4 |
| 2014/0033486 | A1 * | 2/2014 | Beaufrere | A43C 9/06 24/715.6 |
| 2014/0215770 | A1 | 8/2014 | Levesque | |
| 2022/0120298 | A1 | 4/2022 | Patel | |

FOREIGN PATENT DOCUMENTS

| | | |
|---|---|---|
| FR | 3006152 | 12/2014 |
| JP | 2015100482 | 6/2015 |
| TW | 639995 | 4/2023 |

OTHER PUBLICATIONS

Variety Alloy Hoodie Drawstrings, Colorful Drawstring Tips, Smiley Metal Ends for Drawstring Tips, Shoelace Aglets, Stopper Choice 10 Styles, Etsy.com, Obtained Jun. 24, 2023.

Rexhubro Aglet Crimping Tool Adjustable Metal Shoelace Crimper for 3/4/4.5mm Laces Shoelace Aglets Tool for Aglets,Hoodie string end caps, Pants, Amazon.com, Obtained Jun. 24, 2023.

DIY Metal Aglets Shoelace Cylindrical Tips head Tip Protector—Set of Four Tips Easy to Install, Amazon.com, Obtained Jun. 24, 2023.

Moxweyeni 60 Pieces Metal Aglets Shoelace Tips Hoodie String Caps DIY Aglets for Shoelaces Shoelace Caps with Screwdriver Lace Aglets Lace Tips for Canvas Sneakers Hoodies, Amazon.com, Obtained Jun. 24, 2023.

Evaluations of Variety Alloy Hoodie Drawstrings, Colorful Drawstring Tips, Smiley Metal Ends for Drawstring Tips, Shoelace Aglets, Stopper Choice 10 Styles, Etsy.com, Obtained Jun. 24, 2023.

* cited by examiner

ACCESSORY TO PERSONALIZE AND STYLIZE APPAREL

TECHNICAL FIELD

The present disclosure relates generally to apparel accessories and, more particularly, to connectors that can be mounted and displayed on strings used on apparel.

BACKGROUND OF THE DISCLOSURE

Many people want to personalize and add style to their apparel. Therefore, they attach various decorative items on their clothing articles such as aprons, coats, uniforms, jerseys, bathrobes, berets, shorts, blazers, blouses, jackets, boots, shirts, T-shirts, tube tops, business suits, swimming suits, rain gear, caps, hats, sweatshirts, hooded sweatshirts or "hoodies," sweatpants, jeans, gowns, sweaters, flip flops, gloves, dresses, night gowns, overalls, pajamas, parkas, pants, shoes, sandals, sneakers, slippers, scarfs, scrubs, shawls, shorts, slacks, socks, ties, warm-ups, or the like. The decorative items could be attached to drawstrings, laces, cords, or other types of strings and the items serve the purpose of personalizing and styling. Such attachment presents several challenges, however, because it takes time and effort to attach the decorative items on their apparel properly and quickly.

Various attempts have been made to solve the attachment problem. For example, U.S. Patent Application Publication No. 2022/0120298 titled "Attachment Clips For Mounting On Cords" was filed on Dec. 27, 2021 by Nilin Patel. The document discloses attachment clips for mounting and displaying on cords. The attachment clip has a base with a cord attachment portion and an accessory attachment portion disposed on opposite sides of the base. The cord attachment portion allows insertion of one or more cords and includes two jaw portions, each of which has a base attachment portion and a tip portion on the opposite side. A through-hole extends between the jaw portions and an aperture is formed between the tip portions of both opposing jaw portions. A centering element is disposed on an inner side of each jaw portion. Several alternative embodiments of attachment clips are disclosed in detail. The attachment clips are ostensibly easy to attach to cords, provide aesthetic appeal, and could be used for attaching various accessories to the cords.

Modern apparel often have strings that extend through a narrow tubular enclosure (often referred to as a channel which contains the string) in the apparel for the purpose of tightening the apparel about the body. Eyelets provide entrance and exit openings to the channel. Plastic fittings or aglets at either end of the string help prevent fraying of the string and make feeding the string through the eyelets and the tubular enclosure easier. The aglets are preferably made of hard plastic, are approximately 1.25 cm (0.5 inches) long with an inner diameter of approximately 0.25 cm (0.1 inches) in diameter, are cylindrical in shape, and are affixed to the string with adhesive (they may also be heat sealed to the string).

Similarly, other products such as tents, sleeping bags, and school bags often use some form of string to secure the product around its intended target. A damaged string can present a reassembly problem, however, and can cause additional damage to the apparel or other products. The string is also a fashionable accessory to most apparel, and the preference of the user may result in a desire for frequent changing of the string. Known restringing devices do not provide for efficient and secure attachment of the string to the restringing device and are often inadequate in guiding the string through the distances required. Thus, there is a need in the art to provide resilient and fashionable strings that can be easily incorporated into apparel or other products.

One attempt to meet that need is provided by U.S. Pat. No. 10,299,539. Titled "Connectable Drawstrings With Insertion Tool" and issued on May 28, 2019, to Steven Douglas Finley, the patent is directed to a drawstring for drawing together a material and to a method for making the drawstring. In some aspects, the drawstring includes at least one flexible elongate cord having a first end and a second end, wherein the first end includes a first aglet and the second end includes a second aglet, a first connector having a base end and a top end, the base end including a first cavity for receiving the first aglet, and the top end including a first male fastener, a second connector including a rotating element and a fixed element, the rotating element coupled to the fixed element via a swivel, the rotating element including a first female fastener configured to be removably attached to the first male fastener, and the fixed element having a second cavity for receiving the second aglet, wherein the first aglet is enclosed within the first cavity such that the opening to the first cavity is crimped to prevent removal of the first aglet from the first cavity, and wherein the second aglet is enclosed within the second cavity such that the opening to the second cavity is crimped to prevent removal of the second aglet from the second cavity. The first cavity may include a magnet for coupling to a corresponding magnet in the first male fastener. A threading tool can be attached to the drawstring, manipulated by a user for threading the drawstring through a drawstring channel on a garment, and then detached from the drawstring.

Similarly, U.S. Patent Application Publication No. 2014/0215770 discloses a product and method for replacing drawstrings as used in clothing and drawstring-closed items. Titled "Drawstring Connector And Methods Of Use," the published application was filed on Jan. 16, 2014, by Luc Levesque and Michael Anthony Gerstner. A connector for use with a drawstring is described which allows a user to attach one or more drawstrings together. A first end of the connector can be mounted to a first end of a drawstring. A second end of the connector can be mounted either to a second end of the same or to another drawstring. A swivel may be situated between the first and second ends of the connector for rotating the ends and to assist in fastening the connector to the drawstring. The connector may be a permanent fixture to a drawstring or a releasable attachment. The connector may be used in a method of replacing a drawstring of a product with a second drawstring. An end of a first drawstring is connected to an end of the second drawstring via the connector. The first drawstring is pulled until the connected second drawstring has replaced a position of the first drawstring on the product, then the drawstrings are disconnected at the connector.

Despite these attempts, a need exists for an apparel accessory that allows users to personalize and add style to their apparel. Therefore, an object of the present disclosure is to provide an accessory that allows users to attach decorative items to drawstrings, laces, cords, or other types of strings found on apparel. A related object is to allow attachment of the decorative items easily and quickly to the strings. Another object is to meet the need in the art for resilient and fashionable strings that can be easily incorporated into apparel or other products. A further object is to provide a connector that is sturdy and long lasting, minimizes the risk of breakage, offers interchangeability, and provides an almost unlimited number of possible styles of design. Still another object is to avoid the need for complex components that often risk failure, such as springs and fasteners (e.g., screws).

SUMMARY OF THE DISCLOSURE

To meet these and other needs, to achieve these and other objects, and in view of its purposes, the present disclosure provides a modular connector for mounting on a string. The modular connector includes three main components: an integral inner string attachment, an integral intermediate sleeve, and an integral outer decorative cover. The string attachment is configured to grasp substantially permanently the string. The intermediate sleeve is made of a magnetic material, has a head and an inner face with a lip located in the inner face proximate the head, and is configured to enclose and hold the string attachment with the lip blocking the string attachment from exiting the intermediate sleeve after the string attachment has been inserted into the intermediate sleeve. The decorative cover is adorned with an indicia such as a decoration, has a bottom, and is configured to enclose the intermediate sleeve. A magnet is positioned in the bottom of the decorative cover to affix temporarily yet securely the intermediate sleeve flush inside the decorative cover.

Further provided is a kit that allows the combined offering in a single package or container of two or more components (namely, the string attachment, the intermediate sleeve, and the decorative cover) of the modular connector that the end user assembles at the time of use. The kit may also include a document that recites step-by-step instructions for the user to follow when assembling the modular connector. The kit can include one set of the three components of the modular connector packaged together. In still another embodiment, the kit can include multiple sets of the three components. In still another embodiment, the kit can include one string attachment, one intermediate sleeve, and multiple (e.g., two, five, ten, or more) decorative covers. Other combinations of the components can be made to provide alternative kits.

Still further provided is a method by which a user combines the three components to form the modular connector during use of the modular connector. The first step involves the user (or another person) providing the string to which the modular connector will be attached. The user next attaches the string attachment to the string by inserting the end of the string into the string attachment and compressing tines of the string attachment into engagement with the string. Next, the user inserts the string attachment into the intermediate sleeve completely so that a crown of the string attachment lies underneath the lip of the intermediate sleeve, thereby holding the string attachment in the intermediate sleeve. Finally, the user selects a desired decorative cover and inserts the intermediate sleeve (in which the string attachment is held) into the decorative cover.

It is to be understood that both the foregoing general description and the following detailed description are exemplary, but are not restrictive, of the disclosure.

BRIEF DESCRIPTION OF THE DRAWING

The disclosure is best understood from the following detailed description when read in connection with the accompanying drawing. Included in the drawing are the following figures.

DETAILED DESCRIPTION OF THE DISCLOSURE

In this specification and in the claims that follow, reference will be made to a number of terms which shall be defined to have the following meanings ascribed to them. The term "substantially," as used in this document, is a descriptive term that denotes approximation and means "considerable in extent" or "largely but not wholly that which is specified" and is intended to avoid a strict numerical boundary to the specified parameter. Directional terms as used in this disclosure—for example up, down, right, left, front, back, top, bottom—are made only with reference to the figures as drawn and are not intended to imply absolute orientation.

The term "about" means those amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. When a value is described to be about or about equal to a certain number, the value is within ±10% of the number. For example, a value that is about 10 refers to a value between 9 and 11, inclusive. When the term "about" is used in describing a value or an end-point of a range, the disclosure should be understood to include the specific value or end-point. Whether or not a numerical value or end-point of a range in the specification recites "about," the numerical value or end-point of a range is intended to include two embodiments: one modified by "about" and one not modified by "about." It will be further understood that the end-points of each of the ranges are significant both in relation to the other end-point and independently of the other end-point.

The term "about" further references all terms in the range unless otherwise stated. For example, about 1, 2, or 3 is equivalent to about 1, about 2, or about 3, and further comprises from about 1-3, from about 1-2, and from about 2-3. Specific and preferred values disclosed for components and steps, and ranges thereof, are for illustration only; they do not exclude other defined values or other values within defined ranges. The components and method steps of the disclosure include those having any value or any combination of the values, specific values, more specific values, and preferred values described.

The indefinite article "a" or "an" and its corresponding definite article "the" as used in this disclosure means at least one, or one or more, unless specified otherwise. "Include," "includes," "including," "have," "has," "having," comprise," "comprises," "comprising," or like terms mean encompassing but not limited to, that is, inclusive and not exclusive. By "string" is mean a broad category of related items: cords, ropes, draw strings, pull strings, laces, wires, necklaces, bracelets, lanyards, ties, straps, threads, cables, earrings, chain belts, key chains, pet collars, and the like.

Figure 1:
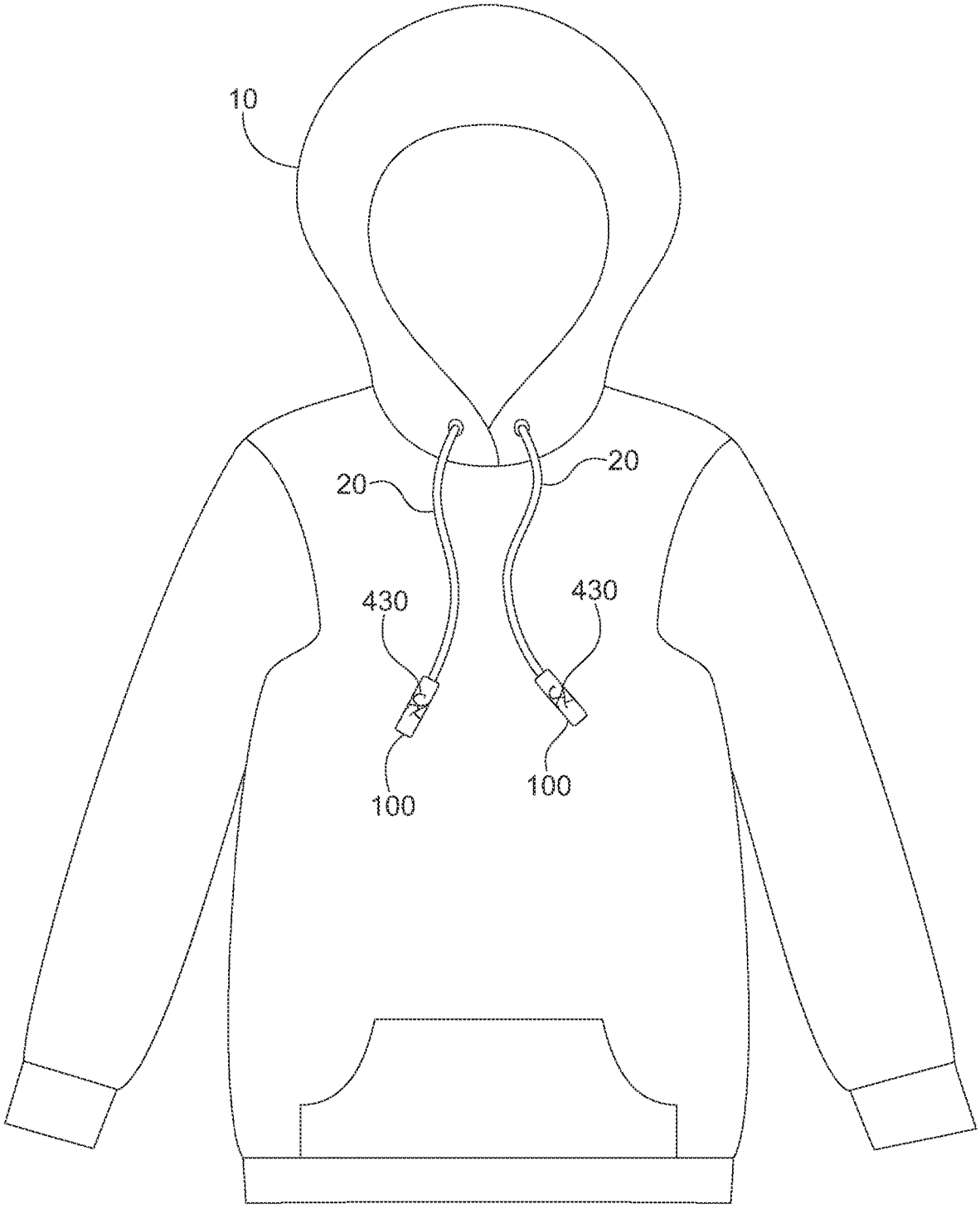
FIG. 1 illustrates a front view of an article of apparel having strings upon which is attached one embodiment of the modular connector according to the present disclosure.

Referring now to the drawing, in which like reference numbers refer to like elements throughout the various figures that comprise the drawing, FIG. 1 illustrates a front view of an article of apparel 10, e.g., a hooded sweatshirt, including a string 20 having two ends or two separate strings 20 upon which two modular connectors 100 according to an embodiment of the present disclosure are affixed. The article of apparel 10 has conventional design features and is commercially available in the market. The modular connector 100 is secured to an end of the string 20 which will be described in greater detail in the below description with the help of the accompanying figures. Further, the modular connector 100 is attached as an accessory to the article of apparel 10.

Still further, in another embodiment, the article of apparel 10 could also include but is not limited to clothing, garments, footwear, and so on. Footwear such as shoes, sneakers, sandals, slippers, and the like is considered apparel, which is another word for personal attire or clothing. Apparel broadly includes any item used to cover the body. Footwear is often considered a subset of clothing, as it serves a similar purpose of providing protection, comfort, and style. Although footwear may be distinct from other clothing items like shirts or pants, footwear still falls under the broader category of personal attire.

The string 20 can be any commercially available string and generally comprises any natural, synthetic, leather or metal fiber, cloth or combinations of these materials. The string 20 may have any suitable length; 122 cm (48 inches) is typical. The string 20 often has ends or aglets 30 (defined as a sheath, typically plastic or metal, on the end of a string) to prevent fraying of the string 20 and to facilitate insertion of the string 20 through a hole in the apparel 10. For example, the aglet 30 may be a cylindrical body having a diameter that is about 3.175 millimeters (0.125 inches). This diameter accommodates most conventional round through-holes in the apparel 10. It should be appreciated, however, that other shapes and sizes are possible if needed to accommodate a different shaped and sized through-hole.

Figure 2:
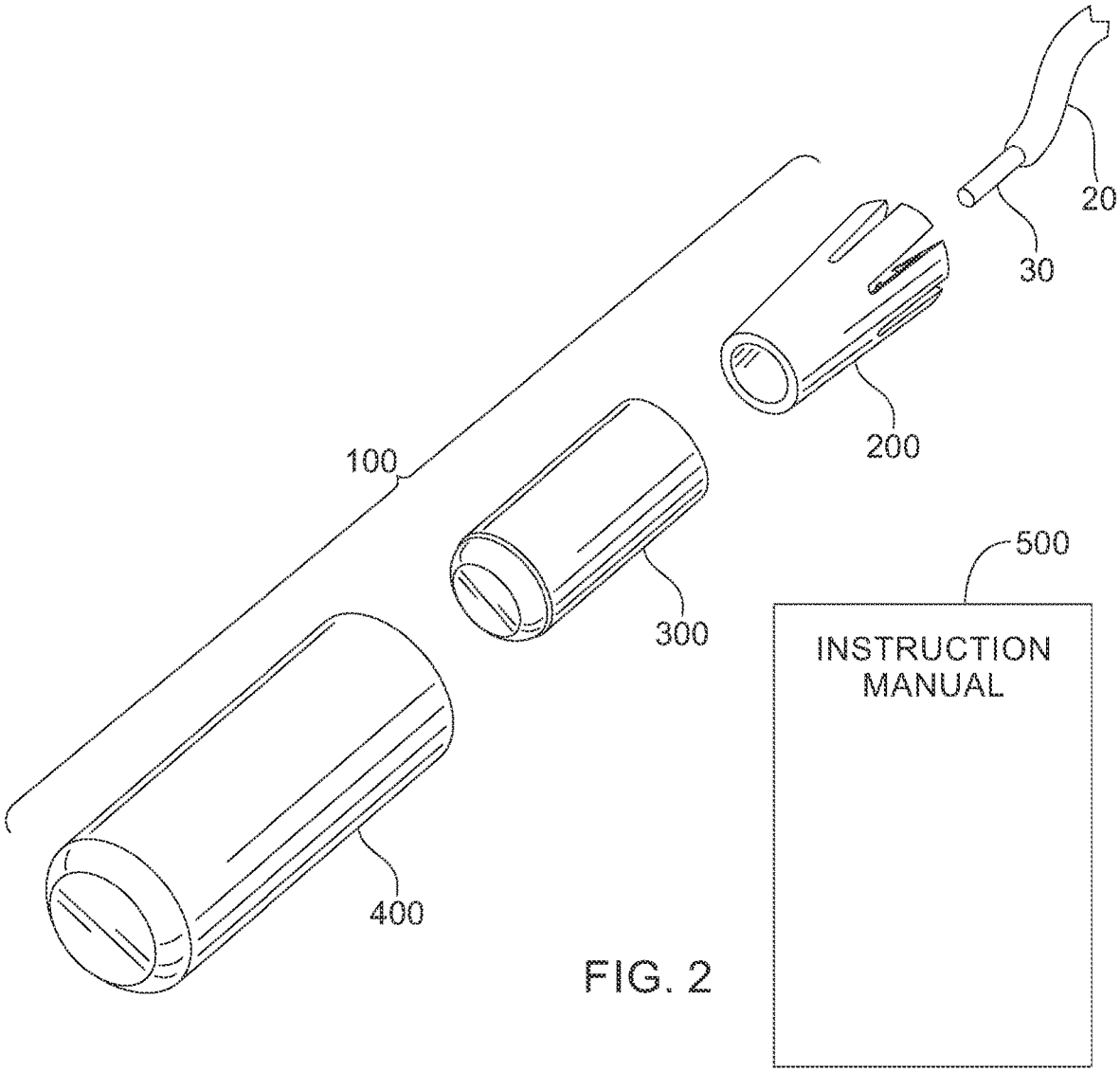
FIG. 2 is a perspective view of one embodiment of a modular connector according to the present disclosure, with the three components of the modular connector (the inner string attachment, the intermediate sleeve, and the outer decorative cover) shown separated, in position to attach to a conventional string having an aglet.

The modular connector 100 can be used to enhance the functionality of the apparel 10 and, simultaneously or independently, as an accessory to personalize and stylize the apparel 10. As illustrated in FIG. 2, the modular connector 100 has at least two, and preferably three, components: (1) an inner string attachment 200; (2) an intermediate sleeve 300 made of a magnetic material such as a metal and having an internal lip; and (3) optionally, an outer decorative cover 400 with a magnet in its bottom. Avoided is the need for other complex components that often risk failure, such as springs and fasteners (e.g., screws). The string attachment 200 is configured to attach to the string 20. Once attached to the string 20, the string attachment 200 is inserted into the intermediate sleeve 300. The combination of the intermediate sleeve 300 and the string attachment 200 alone can achieve many of the functions of the modular connector 100. If the intermediate sleeve 300 (retaining the string attachment 200 inside it) is inserted into the decorative cover 400, however, the remaining functions of the modular connector 100 are achieved. In a preferred embodiment of the modular connector 100, the decorative cover 400 receives the intermediate sleeve 300 which, in turn, receives the string attachment 200 to form a nested configuration.

The string attachment 200, the intermediate sleeve 300, and the decorative cover 400 are each integral components. By "integral" is meant a single piece or a single unitary part that is complete by itself without additional pieces, i.e., the part is of one monolithic piece formed as a unit without another part. The surface of one or more of the string attachment 200, the intermediate sleeve 300, and the decorative cover 400 may have ribs, texture, or other elements to facilitate manipulation by the user. Alternatively, one, two, or all three surfaces may be smooth. Each of the three components of the modular connector 100 is described in more detail as follows.

The Outer Decorative Cover

Figure 4A:
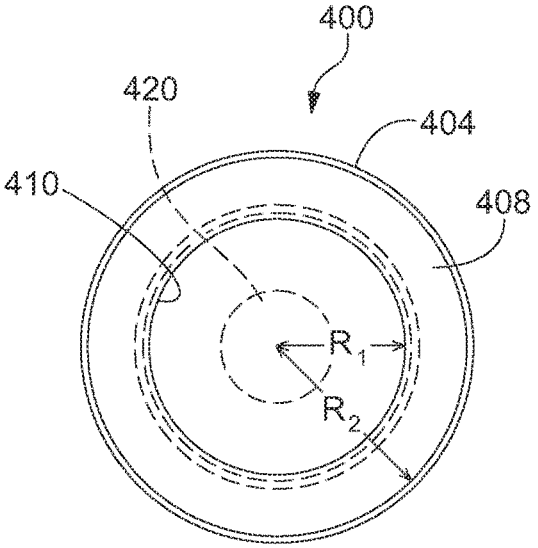
FIG. 4A is a top view of an embodiment of the decorative cover.
Figure 4B:
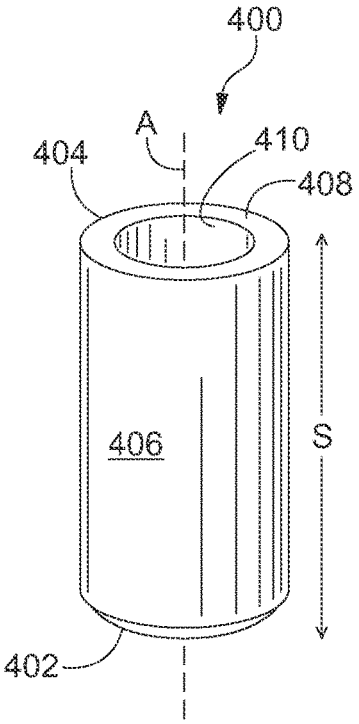
FIG. 4B is a perspective side view of the decorative cover shown in FIG. 4A.
Figure 4C:
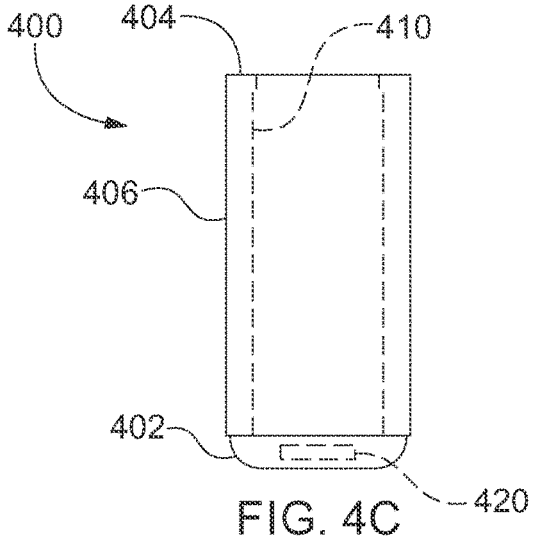
FIG. 4C is a front view of the decorative cover shown in FIG. 4A and FIG. 4B.
Figure 4D:
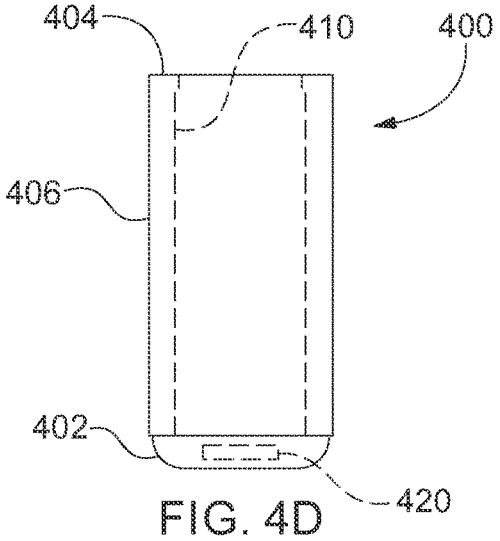
FIG. 4D is a right view of the decorative cover shown in FIG. 4A, FIG. 4B, and FIG. 4C.

The decorative cover 400 is manufactured as one integral unit and may be designed in many different shapes, sizes, and materials. For example, the decorative cover 400 may be made of wood, hard plastic, or metals including precious metals such as but not limited to gold, silver, bronze, and copper plating. Preferably, the decorative cover 400 is a resin-based plastic. The resin-based plastic of the decorative cover 400 may contain colors, diamonds, glitter, blends of colors, and the like. FIG. 4A is a top view, FIG. 4B is a perspective side view, FIG. 4C is a front view, and FIG. 4D is a right view of an embodiment of the decorative cover 400.

The decorative cover 400 may have almost any size and shape imaginable as long as the decorative cover 400 can function to enclose the intermediate sleeve 300. Possible shapes include, among others, a right cylinder, a circle, a rectangle, a star, and animal shapes. Preferably the decorative cover 400 has a hollow right circular cylinder shape. A right circular cylinder is a three-dimensional shape that consists of a bottom 402 and a parallel top 404 linked by a closed round or circular side 406 where each of the bottom 402 and the top 404 is like a circular disk in shape. The line that passes through the center or joins the centers of the circular bottom 402 and the circular top 404 is known as the axis, A, or the longitudinal center line of the decorative cover 400. The decorative cover 400 is symmetrical about the axis A (compare the front view of FIG. 4C with the right view of FIG. 4D).

The distance between the bottom 402 and the top 404 of the cylinder is a perpendicular distance which is represented as the span, "S." A suitable example dimension for the span S is about 35 mm (1.40 inches). The center opening of the decorative cover 400 is defined by an inner side wall 410 and has a radius $R_1$; a suitable example dimension for $R_1$ is about 4 mm (0.16 inches). The distance from the center to the outer boundary for either of the bottom 402 or the top 404 is known as the radius of the right circular cylinder and is represented by $R_2$. A suitable example dimension for $R_2$ is about 5 mm (0.20 inches). The width of a rim 408 of the decorative cover 400 is about 1 mm (0.04 inches), i.e., equal to $R_2$ minus $R_1$. The span S of the decorative cover 400 may also be about 28 mm (1.10 inches). Thus, a right circular cylinder is formed by a combination of two circles and a rectangle.

Once the intermediate sleeve 300 is inserted into the decorative cover 400, it is desirable to temporarily but securely affix those two components together. Such securement is facilitated by selecting suitable dimensions for the two components to that a sliding friction fit occurs between the inner side wall 410 of the decorative cover 400 and the outer surface of the intermediate sleeve 300. Such dimensions are predetermined. By "predetermined" is meant determined beforehand, so that the predetermined characteristic must be determined, i.e., chosen or at least known, in advance of some event (such as manufacture of the components).

In a preferred embodiment, securement can be further or alternatively facilitated by a magnetic attachment. For example, a magnet 420 is provided in the bottom 402 of the decorative cover 400 and the intermediate sleeve 300 is made of a magnetic material. The attractive magnetic force between the magnet 420 of the decorative cover 400 and the intermediate sleeve 300 may be in the range of about 25 to 45 newtons (5.6 to 10.1 pounds-force) or, alternatively, in the range of about 30 to 40 newtons (6.7 to 9 pounds-force). Preferably, the attractive magnetic force between the magnet 420 of the decorative cover 400 and the intermediate sleeve 300 is about 35.5 newtons (8 pounds-force).

The decorative cover 400 can be adorned with any of a number of decorations 430, either in part or around its entire surface. The decorative cover 400 may have an external configuration in the form of a basketball player playing with a basketball. In other embodiments, the decorative cover 400 could have a variety of external configurations, including objects having different three-dimensional geometrical shapes including, without limitation, spheres, polygons, ball configurations (e.g., basketballs, soccer balls, baseballs, and the like), other sporting goods configurations (e.g., hockey pucks, footballs, rugby balls, and the like), three dimensional character configurations (e.g., cartoon characters, animated movie characters, sports, entertainment and popular culture figures, logo configurations, and the like), and other three-dimensional configurations representing animals, objects, and the like. The decorative cover 400 may be provided in a wide variety of sizes as well as three dimensional shapes. In some other embodiments, the decorative cover 400 can include a figure, a symbol, writing, an animal, advertisement items and LED lights, and so on. For example, the decorative cover 400 can include specialized or custom sizes, shapes, or colors designed by the user.

The Intermediate Sleeve

Figure 5A:
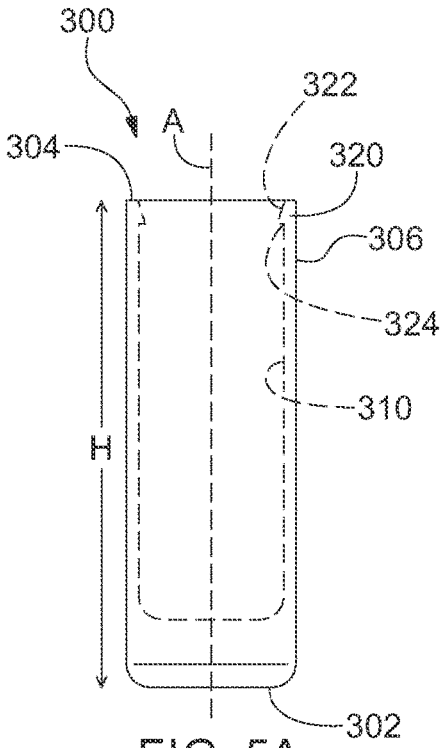
FIG. 5A is a side view of an embodiment of the intermediate sleeve with the intermediate sleeve oriented vertically.
Figure 5B:
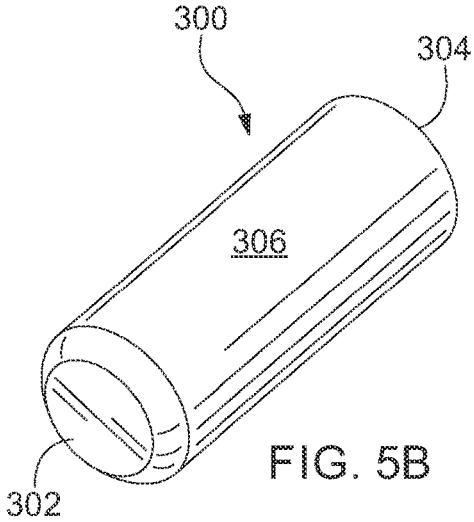
FIG. 5B is a perspective view of the intermediate sleeve shown in FIG. 5A.
Figure 5C:
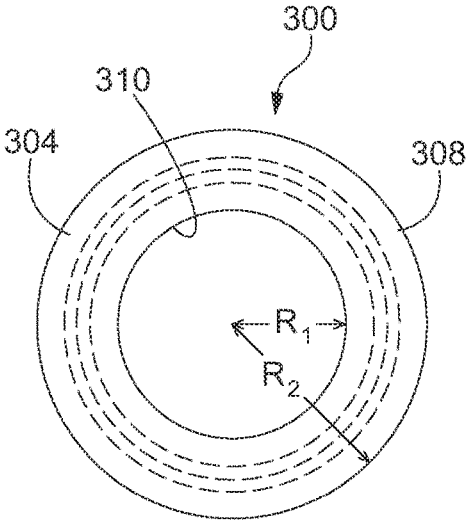
FIG. 5C is a top view of the intermediate sleeve shown in FIG. 5A and FIG. 5B.
Figure 5D:
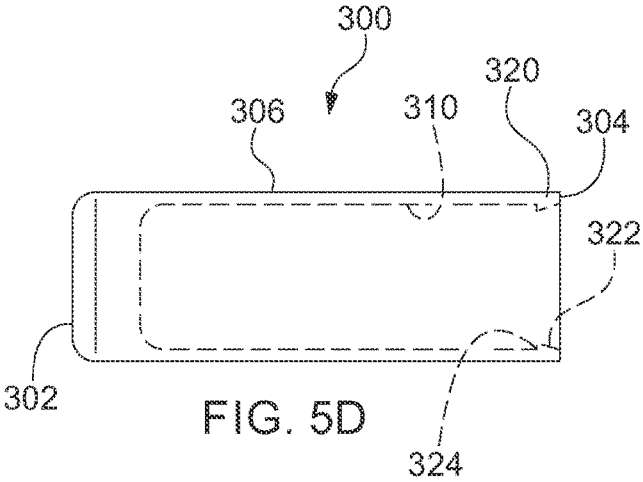
FIG. 5D is a side view of the intermediate sleeve shown in FIG. 5A, FIG. 5B, and FIG. 5C with the intermediate sleeve oriented horizontally.

The intermediate sleeve 300 is manufactured as one integral unit and may be designed in many different shapes, sizes, and materials. To help secure the intermediate sleeve 300 inside the decorative cover 400, the intermediate sleeve 300 is made of a magnetic material so that the intermediate sleeve 300 is attracted to the magnet 420 of the decorative cover 400. Magnetic materials are those materials that naturally possess attractive or repulsive properties over other materials. The phenomenon of attraction and repulsion between materials is called magnetism. Examples of magnetic materials include iron, nickel, cobalt, and ferrite. FIG. 5A is a side view with the intermediate sleeve 300 oriented vertically, FIG. 5B is a perspective view, FIG. 5C is a top view, and FIG. 5D is a side view with the intermediate sleeve 300 oriented horizontally of an embodiment of the intermediate sleeve 300.

The intermediate sleeve 300 may have almost any size and shape imaginable as long as the intermediate sleeve 300 can function to slide into the decorative cover 400 and enclose and hold the string attachment 200. Preferably the intermediate sleeve 300 has a hollow right circular cylinder shape with a foot 302 and a parallel head 304 linked by a closed round or circular side face 306 where each of the foot 302 and the head 304 is like a circular disk in shape. The line that passes through the center or joins the centers of the circular foot 302 and the circular head 304 is known as the axis, A, or the longitudinal center line of the intermediate sleeve 300. The intermediate sleeve 300 is symmetrical about the axis A.

The distance between the foot 302 and the head 304 of the intermediate sleeve 300 is a perpendicular distance which is represented as the height, "H." A suitable example dimension for the height H is about 28.5 mm (1.12 inches). The center opening of the intermediate sleeve 300 is defined by an inner face 310 and has a radius $R_1$; a suitable example dimension for $R_1$ is about 3 mm (0.12 inches). The distance from the center to the outer boundary for either of the foot 302 or the head 304 is known as the radius of the right circular cylinder and is represented by $R_2$. A suitable example dimension for $R_2$ is about 3.5 mm (0.14 inches). The width of a rim 308 of the intermediate sleeve 300 is about 0.5 mm (0.02 inches), i.e., equal to $R_2$ minus $R_1$. The height H of the intermediate sleeve 300 may also be about 20 mm (0.80 inches).

The various dimensions of the intermediate sleeve 300 are predetermined so that the intermediate sleeve 300 can properly engage with the string attachment 200 and with the decorative cover 400. When the intermediate sleeve 300 is inserted completely into the decorative cover 400, the head 304 of the intermediate sleeve 300 is co-planar with the top 404 of the decorative cover 400 (i.e., the intermediate sleeve 300 is flush inside the decorative cover 400). Thus, the intermediate sleeve 300 is entirely covered by the decorative cover 400.

Figure 3:
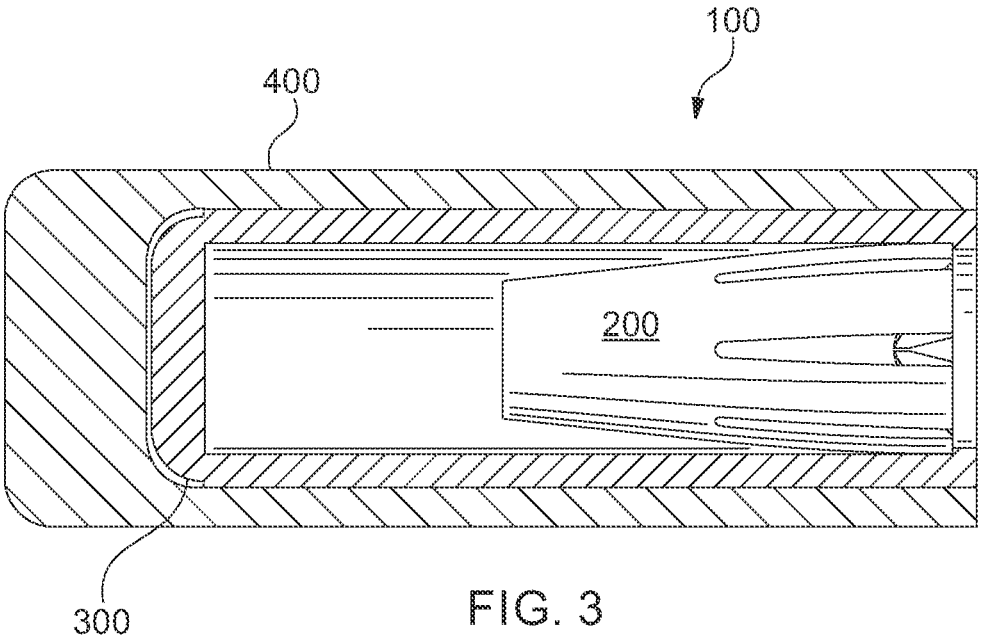
FIG. 3 is a cross-sectional view of the modular connector shown in FIG. 2 with the three components assembled.

A lip 320 is located in the inner face 310 of the intermediate sleeve 300 proximate the head 304. In one embodiment, the lip 320 has a taper 322 that begins at the head 304 and slopes inwardly to a horizontal ledge 324. Thus, the lip 320 looks somewhat like a human nose. The horizontal ledge 324 is perpendicular to the inner face 310. In another embodiment, shown in FIG. 3, the lip 320 more simply has only the horizontal ledge 324. The lip 320 functions to permanently retain the string attachment 200 inside the intermediate sleeve 300 after the string attachment 200 is inserted into the intermediate sleeve 300. This function is achieved because the lip 320 blocks or prevents the string attachment 200 from exiting the intermediate sleeve 300.

The String Attachment

Figure 6A:
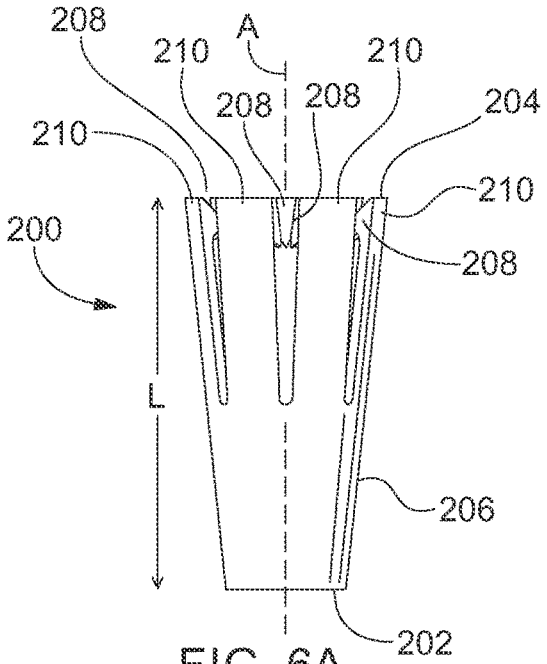
FIG. 6A is a side view of an embodiment of the string attachment with the string attachment oriented vertically.
Figure 6B:
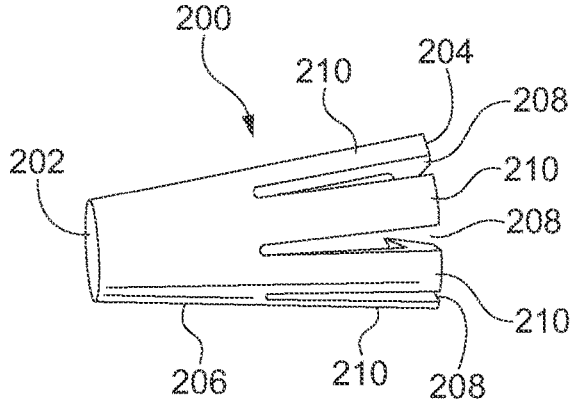
FIG. 6B is a perspective view of the string attachment shown in FIG. 6A.
Figure 6C:
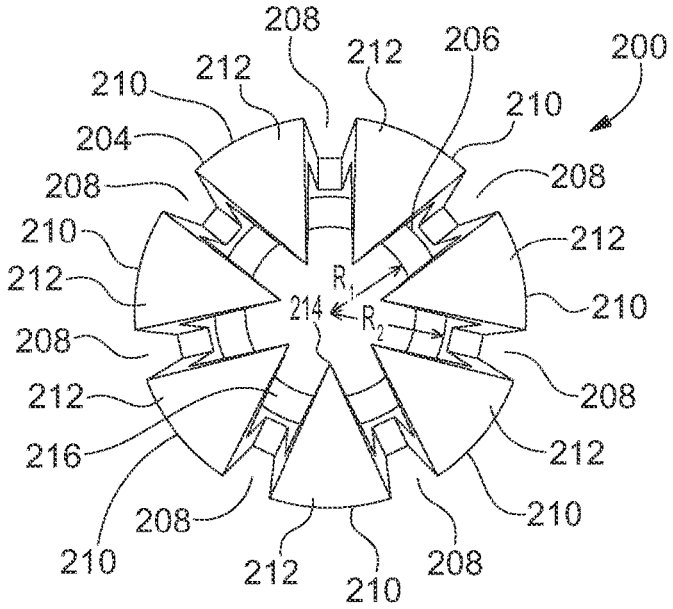
FIG. 6C is a top view of the string attachment shown in FIG. 6A and FIG. 6B.
Figure 6D:
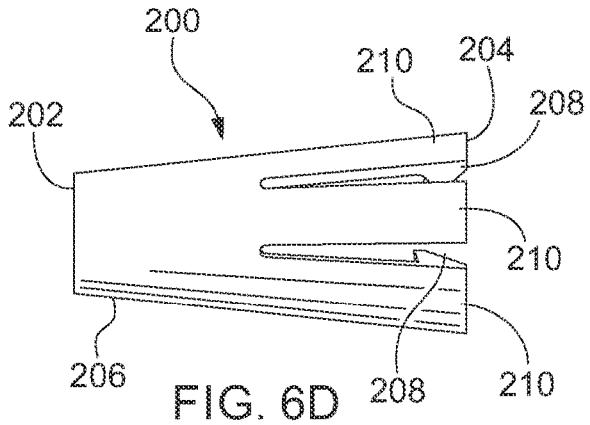
FIG. 6D is a side view of the string attachment shown in FIG. 6A, FIG. 6B, and FIG. 6C with the string attachment oriented horizontally.

The string attachment 200 is manufactured as one integral unit and may be designed in many different shapes, sizes, and materials. The string attachment 200 is preferably made of resin plastic. FIG. 6A is a side view with the string attachment 200 oriented vertically, FIG. 6B is a perspective view, FIG. 6C is a top view, and FIG. 6D is a side view with the string attachment 200 oriented horizontally of an embodiment of the string attachment 200.

The string attachment 200 may have almost any size and shape imaginable as long as the string attachment 200 can function both to slide into the intermediate sleeve 300 and to grasp substantially permanently any of the conventional strings 20. Preferably the string attachment 200 has a hollow frustoconical shape with a base 202 and a parallel crown 204 linked or connected by a closed round body 206 where each of the base 202 and the crown 204 is like a circular disk in shape. The line that passes through the center or joins the centers of the circular base 202 and the circular crown 204 is known as the axis, A, or the longitudinal center line of the string attachment 200. The string attachment 200 is symmetrical about the axis A.

Frustoconical is an adjective used to describe a shape that is a combination of a frustum and a cone. A frustum is a geometric shape that is created when the crown of a cone is cut off by a plane parallel to its base. Therefore, a frustoconical shape has a wider crown than its base and tapers from the crown towards the base.

The distance between the base 202 and the crown 204 of the string attachment 200 is a perpendicular distance which is represented as the length, "L." A suitable example dimension for the length L is about 20 mm (0.80 inches). Another suitable example dimension for the length L is about 16 mm (0.63 inches). The center opening of the base 202 of the string attachment 200 has a radius $R_1$; a suitable example dimension for $R_1$ is about 1.5 mm (0.06 inches). The distance from the center to the outer periphery of the base 202 is represented by $R_2$. A suitable example dimension for $R_2$ is about 2.5 mm (0.10 inches). The width of a rim 216 of the base 202 of the string attachment 200 is about 1 mm (0.04 inches), i.e., equal to $R_2$ minus $R_1$. The various dimensions of the string attachment 200 are predetermined so that the string attachment 200 can properly engage with the intermediate sleeve 300 and with strings 20.

The string attachment 200 has a plurality of individual tines 210 formed in the body 206. The tines 210 are separated from each other by spaces or gaps 208 so that, preferably, the tines 210 are spaced equally around the circumference of the string attachment 200. Although seven tines 210 are illustrated in FIG. 6C, the number of tines 210 can vary depending on the application. Therefore, as few as two tines 210, three tines 210, four tines 210, five tines 210, six tines 210, and eight or more tines 210 may be suitable. The tines 210 preferably extend from about the midpoint of the body 206 to the crown 204 of the string attachment 200 (i.e., the tines 210 extend about half or 50% of the length L of the string attachment 200 between the base 202 and the crown 204).

The end of each of the tines 210 has a tooth 212 with a sharp edge 214 pointing inward toward the axis A. Thus, the ends of the tines 210 preferably have a triangular shape as best illustrated in FIG. 6C. Other shapes of the ends of the tines 210 are possible, however, and can include shapes such as a V-shape, a zigzag shape, and so on. The teeth 212 are designed and configured to grip and hold onto the string 20 securely, with the sharp edges 214 of the teeth 212 penetrating into the string 20, such that the string attachment 200 does not accidentally slip or disengage when the string attachment 200 is attached to the string 20. Preferably, the string 20 is held in a centered position within the string attachment 200. The material used to construct the string attachment 200 and, therefore, the tines 210 of the string attachment 200 must be sufficiently flexible to allow a user to pinch the tines 210 (i.e., push the tines 210 together toward the axis A) into engagement with the string 20 yet sufficiently rigid for the tines 210 to hold the string 20 securely once engagement has been completed. As an alternative to requiring the user to pinch the tines 210 into engagement with the string 20, the tines 210 can automatically be pinched into engagement with the string 20 by the intermediate sleeve 300 as the string attachment 200 slides into the intermediate sleeve 300.

The modular connector 100 as described above offers a number of advantages. The modular connector 100 is relatively easy for a user to install on the string 20 and fits strings 20 of a variety of types and having a variety of sizes. No external tools such as crimping tools, pliers, screwdrivers, or the like are required either to assemble the modular connector 100 or to attach the modular connector 100 to the string 20. Nor is any adhesive required. Therefore, the modular connector 100 is convenient and practical to use. The modular connector 100 is made of materials that render it sturdy and reliable.

The decorative cover 400 is easily removed by the user from the intermediate sleeve 300 and, therefore, from the modular connector 100. The decorative cover 400 of the modular connector 100 is interchangeable in that it can be switched and replaced. Thus, the user can remove a first decorative cover 400 from the modular connector 100 attached to a first string 20 and (i) replace it with a second decorative cover 400 on that first string 20, (ii) attach the first decorative cover 400 to the modular connector 100 attached to a second string 20, or (iii) both. Each decorative cover 400 has a different color or style, offers a variety of color and style selections, and provides an option to interchange among apparel. Thus, the modular connector 100 can differentiate the apparel of one user from the apparel of others.

The modular connector 100 can also be used to add a professional, ornamental, and decorative touch to hoodies, pants, and other apparel that include strings 20. The modular connector 100 allows its wearer to make a fashion statement, enhancing the appearance of the apparel to which the modular connector 100 is attached; provide identification; send a message; or a combination of these functions. Thus, indicia imprinted or otherwise affixed to the surface of the decorative cover 400 of the modular connector 100 can include messages, photographs, pictures such as smiley faces, names (including the name of an individual, a team name, or a product name), numbers, letters, logos, and the like. The indicia can be presented in a variety of fonts and colors, and may include a color pattern or weave. The modular connector 100 may also incorporate visual features in the form of an LED light, for example, and/or audio features via a prerecorded audio message, sound, musical composition (or the like).

When strings 20 such as shoelaces become frayed they can come undone. The disclosed modular connector 100 renders strings 20 longer lasting, improving their useful life span, because neither the aglets 30 of those strings 20 nor the strings 20 themselves will fray or break while protected by the modular connector 100. In fact, the user can cover and protect low-quality plastic aglets 30 and the ends of strings 20 with the modular connector 100, preventing them from breaking or fraying. The modular connector 100 can also be used to repair frayed strings 20. Further still, modular connectors 100 can be applied to both ends of a string 20, preventing the string 20 from losing threads and making it easier to insert the string 20 into eyelets or lace holes.

The modular connector 100 described above offers yet another advantage. The modular connector 100 also allows the user (a consumer or manufacturer) to adjust the length of strings 20 easily to fit a preferred length; the user can cut the string 20 to a desired length and then attach the modular connector 100 to the end of the shortened string 20. The proper length of a string 20 depends upon several factors such as the style and size of the apparel 10 to which the string 20 is attached. The personal preferences of the users also lead to different desired lengths of strings 20. It is difficult for apparel manufacturers to supply apparel 10 with strings 20 which meet all the preferences of the many different potential apparel purchasers. Manufacturers often try to provide strings 20 which are of a length that is a "happy medium" between the longest and shortest lengths a customer may desire for a particular item of apparel 10. As a result, consumers are often faced with strings 20 that are of an undesired length. This is not only an annoyance but can be dangerous if the apparel 10 cannot be tied properly or is subject to coming untied, thus resulting in a tripping hazard or the possibility the string 20 may become entangled in machinery, a bicycle chain, etc. In addition, manufacturers may lose sales of apparel 10 due to improper string length.

There are few convenient mechanisms by which a consumer or manufacturer can readily alter the length of a string 20, thereby allowing the use of "one size fits all" strings 20 whose length can be adjusted, such as by a customer, according to the apparel style and size, the positions of the string eyelets, the user's personal preferences, and other factors. U.S. Pat. No. 7,251,868 issued to Sporting Innovations Group, LLC on Aug. 7, 2007, provides one mechanism. Titled "Adjustable Shoelace," the patent discloses an improved shoelace with adjustable aglets such that the length of the shoelace is readily adjustable, a method for adjusting the length of a shoelace, and an improved shoe incorporating the adjustable shoelace such that purchasers of the shoe can adjust the shoelace length. The modular connector 100 offers an alternative mechanism by which a consumer or manufacturer can readily alter the length of a string 20.

The modular connector 100 can be commercially sold as a kit. The kit allows the combined offering in a single package or container of two or more components (namely, the string attachment 200, the intermediate sleeve 300, and the decorative cover 400) of the modular connector 100 that the end user assembles at the time of use. The kit may also include a document 500 that recites step-by-step instructions for the user to follow when assembling the modular connector 100.

The kit can include one set of the three components of the modular connector 100 packaged together. In still another embodiment, the kit can include multiple sets of the three components. In still another embodiment, the kit can include one string attachment 200, one intermediate sleeve 300, and multiple (e.g., two, five, ten, or more) decorative covers 400. Other combinations of the components can be made to provide alternative kits.

Also disclosed is a method by which a user combines the three components to form the modular connector 100 during use of the modular connector 100. The first step involves the user (or another person) providing the string 20 to which the modular connector 100 will be attached. The user next attaches the string attachment 200 to the string 20 by inserting the end of the string 20 into the string attachment 200 and compressing the tines 210 of the string attachment 200 so that the sharp edges 214 on the teeth 212 of the tines 210 engage the string 20. Next, the user inserts the string attachment 200 into the intermediate sleeve 300 completely so that the crown 204 of the string attachment 200 lies underneath the lip 320 of the intermediate sleeve 300, thereby holding the string attachment 200 in the intermediate sleeve 300. Finally, the user selects a desired decorative cover 400 and inserts the intermediate sleeve 300 (in which the string attachment 200 is held) into the decorative cover 400.

Figure 7:
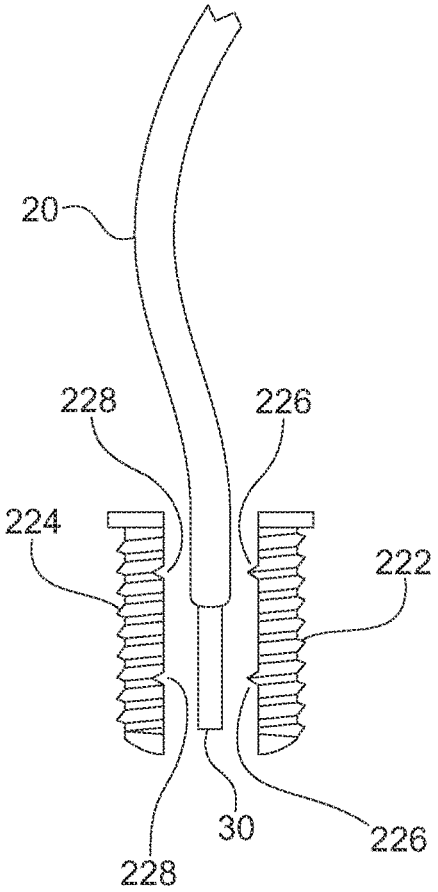
FIG. 7 illustrates an embodiment of the string attachment formed by two screws before the two screws are combined to form a clasp.
Figure 8:
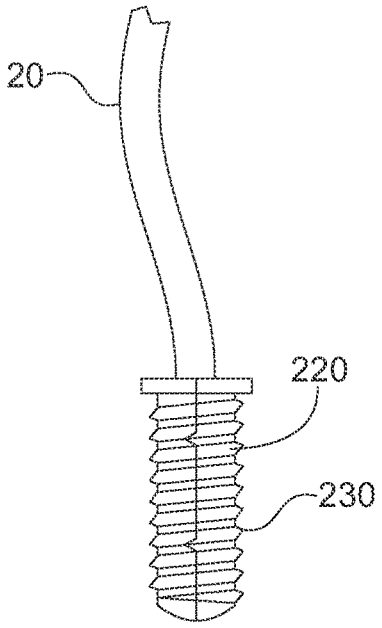
FIG. 8 depicts the string attachment shown in FIG. 7 after the two screws are combined to form the clasp.

FIGS. 7 through 12B illustrate another embodiment of the modular connector 100. As shown in FIG. 7, the string attachment is formed by two screws: a first screw 222 and a second screw 224. Although a variety of materials can be used to form the screws 222 and 224, metal is preferred. Each screw 222, 224 combines to form one half of a barrel or torpedo clasp 220. Preferably, the screws 222, 224 are hollow so that they can receive the string 20 and/or the aglet 30 between them and hold the string 20 and the aglet 30 securely when the screws 222, 224 are combined to form the clasp 220. FIG. 7 shows the screws 222, 224 before, and FIG. 8 shows the screws 222, 224 after, they are combined. The clasp 220 has an external thread 230.

The screws 222, 224 may be affixed to the string 20, to the aglet 30, or to both the string 20 and the aglet 30 by multiple sharp projections 226 that extend horizontally inward from one or both of the screws 222, 224. In the example embodiment illustrated in FIG. 7, the first screw 222 has two sharp projections 226 configured to pass through the string 20, the aglet 30, or both the string 20 and the aglet 30 and nest in corresponding grooves 228 formed in the second screw 224. No separate joining or linking mechanism is provided between the first screw 222 and the second screw 224 to form the clasp 220.

Figure 7A:
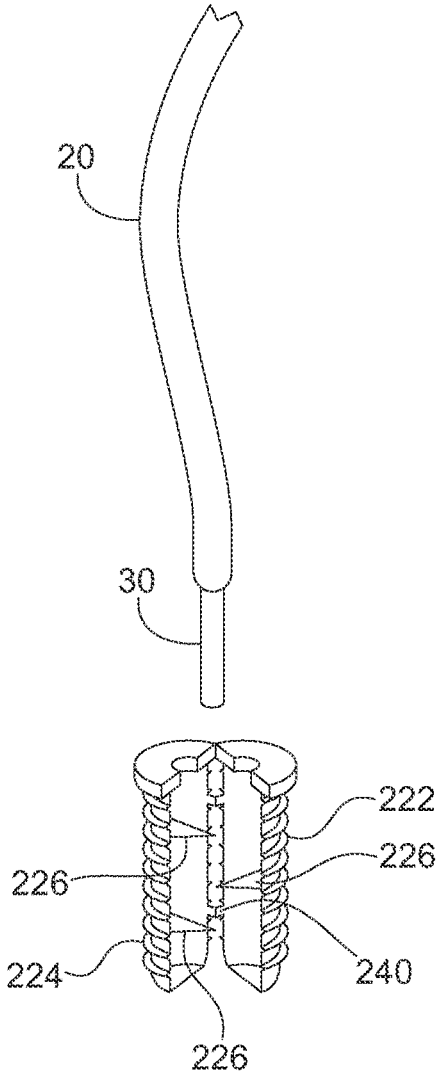
FIG. 7A illustrates an embodiment of the string attachment formed by two screws joined by a common door or hinge to form a clasp.

Alternatively, as shown in FIG. 7A, the first screw 222 and the second screw 224 can be joined by a common door or hinge 240 that allows the screws 222, 224 to rotate or pivot into open and closed positions. The screws 222, 224 form the clasp 220 when pivoted into their completely closed position. In the example embodiment illustrated in FIG. 7A, the first screw 222 has one sharp projection 226 and the second screw 224 has two sharp projections 226 with all of the sharp projections 226 configured to pass through the string 20, the aglet 30, or both the string 20 and the aglet 30. The sharp projections 226 are located on the first screw 222 and the sharp projections 226 are located on the second screw 224 so that they complement and do not interfere with each other when the first and second screws 222, 224 are rotated into their closed position and the clasp 220 is formed.

The hinge 240 is just one of many alternative joining or linking mechanisms that can be provided between the first screw 222 and the second screw 224 to form the clasp 220. Another example is a catch formed on the first screw 222 and a latch formed on the second screw 224; the latch engages the catch when the screws 222, 224 are closed and form the clasp 220. A ball and socket configuration can also be provided for attachment purposes. Other types of fasteners are possible to attach the two screws 222, 224 together to form the clasp 220. One fastener is coupled to the first screw 222 and is configured for attaching to a complimentary fastener of the second screw 224. Thus, in a preferred embodiment, the fastener of the first screw 222 compliments the fastener of the second screw 224. For instance, the fastener of the first screw 222 may be configured as a female fastener and the fastener of the second screw 224 may be configured as a male fastener. The fasteners may be male and female snaps. Any type of fastener that is practical in nature and size for use on the first and second screws 222, 224 and that has sufficient hold would suffice. The fasteners may include magnets, loops, snaps, and Velcro© material (Velcro© is the brand name of the first commercially marketed fabric hook-and-loop fastener sold by Velcro USA, Inc. of Manchester, New Hampshire) among other types of fasteners.

At least one of the screws, for example the first screw 222, includes a lock and grip mechanism such as teeth, hooks, barbs, studs, and the like to affix the first screw 222 to the string 20, the aglet 30, or both the string 20 and the aglet 30. The mechanism preferably pierces the string 20 and/or the aglet 30. The second screw 224 also may have a similar lock and grip mechanism. If both the first and second screws 222, 224 each have a respective lock and grip mechanism, the mechanisms must be arranged to complement and not interfere with each other. No adhesive is used to fix the screws 222, 224 to the string 20, the aglet 30, or both the string 20 and the aglet 30.

Figure 9:
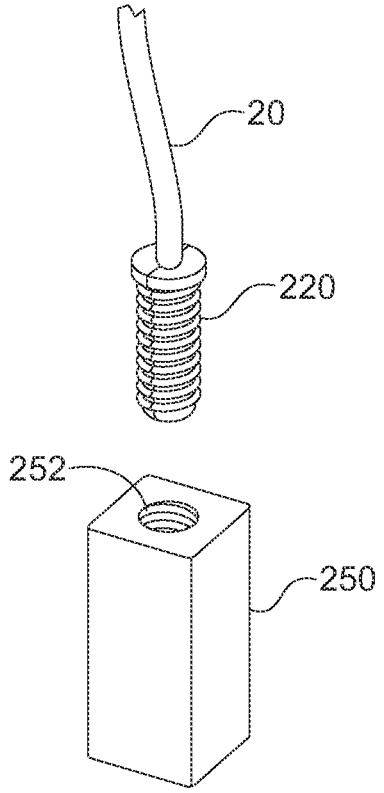
FIG. 9 illustrates the clasp shown in FIG. 8 and an embodiment of the decorative cover before those two components are engaged.
Figure 10:
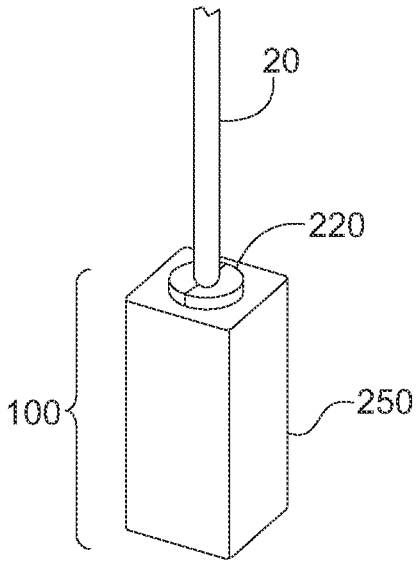
FIG. 10 illustrates the clasp and the decorative cover shown in FIG. 9 after those two components are engaged to form an embodiment of the modular connector.

In the embodiment of the modular connector 100 first described above, the string attachment 220 is configured to engage the decorative cover 400 (albeit through the intermediate sleeve 300). Similarly, for the embodiment of the modular connector 100 now described, and as illustrated in FIGS. 9 and 10, the clasp 220 form of the string attachment is configured to engage a decorative cover 250. Although a variety of materials can be used to form the decorative cover 250, metal is preferred. FIG. 9 illustrates the clasp 220 and the decorative cover 250 before those two components are engaged. FIG. 9 further shows that the decorative cover 250 has an internal thread 252 that corresponds to the external thread 230 on the clasp 220. Thus, the user can screw or rotate the decorative cover 250 onto the clasp 220, thereby engaging fully the internal thread 252 and the external thread 230, to form the modular connector 100 as illustrated in FIG. 10.

Like the decorative cover 400, the decorative cover 250 can have a variety of shapes such as rectangular, triangular, and circular; sizes; and colors and can be provided with different designs or decorations. A rectangular shape for the decorative cover 250 is illustrated in FIGS. 9 and 10 as one example. A suitable length for the decorative cover 250 is about 2.5 cm (1 inch). Also like the decorative cover 400, the decorative cover 250 is interchangeable on the clasp 220 and can be removed and used on other items of apparel.

Figure 11A:
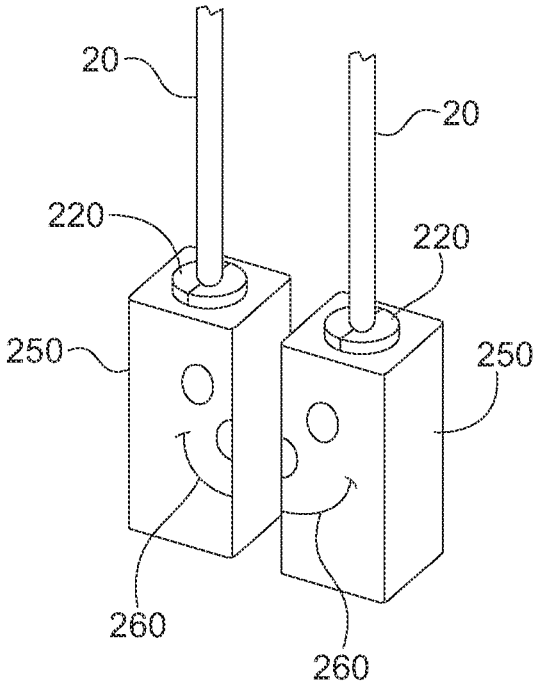
FIG. 11A shows two ends of a string or two separate strings upon which are attached two decorative covers and clasps as illustrated in FIG. 10, with each decorative cover having one-half of an indicia.
Figure 11B:
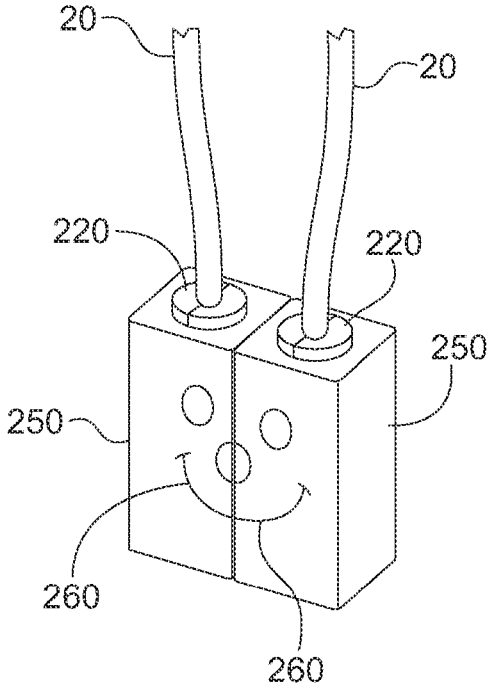
FIG. 11B illustrates the two decorative covers and clasps shown in FIG. 11A joined together.
Figure 12A:
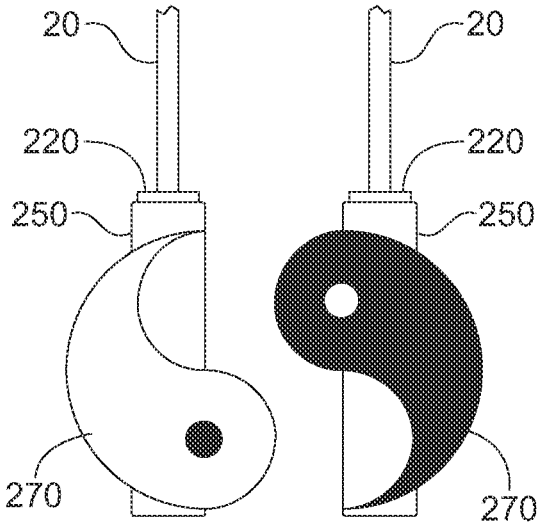
FIG. 12A shows two ends of a string or two separate strings upon which are attached two decorative covers and clasps as illustrated in FIG. 10, with each decorative cover having one-half of a shape.
Figure 12B:
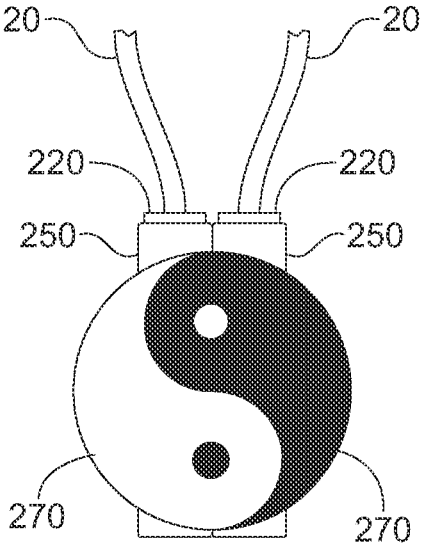
FIG. 12B illustrates the two decorative covers and clasps shown in FIG. 12A joined together.

Recall that FIG. 1 illustrates the article of apparel 10 including the string 20 having two ends or two separate strings 20 upon which two modular connectors 100 are attached. FIG. 11A shows the two ends of the string 20 or two separate strings 20 of the apparel 10 upon which two decorative covers 250 are attached using the clasp 220. In this embodiment, each decorative cover 250 can be made of a magnetic material (or can include a magnet) so that the two decorative covers 250 are attracted to each other. Therefore, when in use, the two decorative covers 250 can be joined together as shown in FIG. 11B. It is also possible, as shown in FIGS. 11A and 111B, to provide one-half of an indicia 260 on one of the two decorative covers 250 and the other half of the indicia 260 on the other of the two decorative covers 250 so that the full indicia 260 is depicted when the two decorative covers 250 are joined together. Similarly, as shown in FIGS. 12A and 12B, one-half of a shape 270 can be provided on one of the two decorative covers 250 and the other half of the shape 270 can be provided on the other of the two decorative covers 250 so that the full shape 270 (e.g., a circle) is created when the two decorative covers 250 are joined together.

Further disclosed is a method by which a user combines the two components (the clasp 220 and the decorative cover 250) to form the modular connector 100 during use of the modular connector 100. The first step involves the user (or another person) providing the apparel 10 including the string 20 to which the modular connector 100 will be attached. The user next attaches the clasp 220 to the string 20 by inserting the end of the string 20 into the clasp 220 and closing the clasp 220 around the string 20 so that the sharp projections 226 engage the string 20. The user then selects a desired decorative cover 250 and threads the decorative cover 250 onto the clasp 220. Finally, if two decorative covers 250 are in use and are magnetically attracted, the two decorative covers 250 can be joined together.

Still further disclosed is a process of manufacturing the modular connector 100. The components can be molded and, if necessary, machined. The components can also be made using a 3D printer. The materials of construction assure that the modular connector 100 can endure long-lasting use.

Although illustrated and described above with reference to certain specific embodiments and examples, the present disclosure is nevertheless not intended to be limited to the details shown. Rather, various modifications may be made in the details within the scope and range of equivalents of the claims and without departing from the spirit of the disclosure.

What is claimed:

1. A modular connector for mounting on a string, the modular connector comprising:

an integral inner string attachment configured to grasp substantially permanently the string;

an integral intermediate sleeve made of a magnetic material, having a head and an inner face with a lip located in the inner face proximate the head, and being configured to enclose and hold the string attachment with the lip blocking the string attachment from exiting the intermediate sleeve after the string attachment has been inserted into the intermediate sleeve;

an integral outer decorative cover adorned with an indicia, having a top and a bottom, and being configured to enclose the intermediate sleeve; and a magnet positioned in the bottom of the decorative cover to affix temporarily yet securely the intermediate sleeve inside the decorative cover.

2. The modular connector according to claim 1 wherein the decorative cover is made of a resin-based plastic.

3. The modular connector according to claim 1 wherein the decorative cover has a shape of a hollow right circular cylinder.

4. The modular connector according to claim 1 wherein an attractive magnetic force between the magnet of the decorative cover and the intermediate sleeve is in a range of 30 to 40 newtons.

5. The modular connector according to claim 1 wherein the head of the intermediate sleeve is substantially co-planar with the top of the decorative cover when the intermediate sleeve is inserted completely into the decorative cover.

6. The modular connector according to claim 1 wherein the string attachment has a center longitudinal axis; a circumference; and a body with a plurality of individual tines formed in the body and separated from each other by gaps so that the tines are spaced equally around the circumference, each of the tine having an end with a tooth including a sharp edge pointing inward toward the center longitudinal axis for gripping the string.

7. The modular connector according to claim 6 wherein a material used to construct the string attachment is sufficiently flexible to allow the tines to be pushed together toward the center longitudinal axis into engagement with the string yet sufficiently rigid for the tines to hold the string securely once engagement has been completed.

8. The modular connector according to claim 6 wherein the body has a length and the tines extend about half of the length of the body.

9. The modular connector according to claim 1 wherein the string attachment is made of a resin-based plastic.

10. The modular connector according to claim 1 wherein the string attachment has a hollow frustoconical shape.

11. A kit for mounting a modular connector on a string, the kit comprising:

an integral inner string attachment configured to grasp substantially permanently the string;

an integral intermediate sleeve having a head and an inner face with a lip located in the inner face proximate the head, and being configured to enclose and hold the string attachment with the lip blocking the string attachment from exiting the intermediate sleeve after the string attachment has been inserted into the intermediate sleeve;

at least one integral outer decorative cover adorned with an indicia, having a top and a bottom, and being configured to enclose the intermediate sleeve; and wherein the intermediate sleeve is made of a magnetic material and the at least one decorative cover has a magnet positioned in the bottom of the decorative cover to affix temporarily yet securely the intermediate sleeve inside the decorative cover.

12. The kit according to claim 11, further comprising a plurality of decorative covers.

13. The kit according to claim 11, further comprising a document that recites step-by-step instructions for a user to follow when assembling the modular connector and mounting the modular connector on the string.

14. A method for mounting a modular connector on a string, the method comprising:

providing the string to which the modular connector will be attached;

providing the modular connector, the modular connector having (i) an integral inner string attachment including a body with a crown and a plurality of individual tines formed in the body and separated from each other by gaps, each of the tine having an end with a tooth including a sharp edge for gripping the string, and (ii) an integral intermediate sleeve having a head and an inner face with a lip located in the inner face proximate the head, and being configured to enclose and hold the string attachment with the lip blocking the string attachment from exiting the intermediate sleeve after the string attachment has been inserted into the intermediate sleeve;

attaching the string attachment to the string by inserting an end of the string into the string attachment and compressing the tines of the string attachment so that the sharp edges on the teeth of the tines engage the string; and inserting the string attachment into the intermediate sleeve completely so that the crown of the string attachment lies underneath the lip of the intermediate sleeve, thereby holding the string attachment in the intermediate sleeve.

15. The method according to claim 14, further comprising a step of selecting an integral outer decorative cover adorned with an indicia, having a top and a bottom, and being configured to enclose the intermediate sleeve.

16. The method according to claim 15, further comprising the step of inserting the intermediate sleeve into the decorative cover.

17. The method according to claim 16, wherein the intermediate sleeve is made of a magnetic material and the decorative cover has a magnet positioned in the bottom of the decorative cover so that, when the intermediate sleeve is inserted into the decorative cover, the intermediate sleeve is temporarily yet securely affixed inside the decorative cover.

18. The method according to claim 16 wherein the head of the intermediate sleeve is substantially co-planar with the top of the decorative cover when the intermediate sleeve is inserted completely into the decorative cover.

* * * * *